United States Patent [19]

Hess et al.

[11] 4,004,055

[45] Jan. 18, 1977

[54] INHIBITING STRESS CRACKING

[76] Inventors: Daniel N. Hess, 4705 Yadkin Drive, Raleigh, N.C. 27609; Ramon A. Bannister, P.O. Box 593, Sullivan's Island, S.C. 29482

[22] Filed: Apr. 21, 1975

[21] Appl. No.: 569,689

Related U.S. Application Data

[63] Continuation-in-part of Ser. No. 254,452, May 18, 1972, Pat. No. 3,880,585.

[52] U.S. Cl. ..... 427/431; 427/239; 29/196

[51] Int. Cl.[2] ..... C23C 1/10

[58] Field of Search ..... 427/436, 431, 239, 329; 29/196; 21/2.7 R; 176/38, 92 B, 86 M, 64, 50

[56] References Cited

UNITED STATES PATENTS

| | | | |
|---|---|---|---|
| 2,945,794 | 7/1960 | Winters et al. | 176/46 |
| 3,089,840 | 5/1963 | Carter et al. | 176/92 B X |
| 3,880,585 | 4/1975 | Hess et al. | 21/2.7 R |

OTHER PUBLICATIONS

Berry, Corrosion in Nuclear Applications, John Wiley and Sons, N.Y., pp. 318–321.

*Primary Examiner*—Ralph S. Kendall

[57] ABSTRACT

A method of inhibiting stress cracking of stainless steel exposed to a chloride-ion containing fluid environment which comprises coating the surface of the stainless steel with at least a trace amount of metallic mercury. The invention also contemplates the mercury/stainless steel amalgam.

1 Claim, No Drawings

INHIBITING STRESS CRACKING

CROSS-REFERENCE TO RELATED APPLICATION

This application is a continuation-in-part of copending application, Ser. No. 254,452 filed May 18, 1972 and now U.S. Pat. No. 3,880,585.

BACKGROUND OF THE INVENTION

1. Field of the Invention

This invention relates to inhibiting stress cracking in stainless steel. More particularly, this invention relates to the use of metallic mercury to inhibit stress cracking of stainless steel in a chloride-ion environment. This invention further contemplates mercury/stainless steel as an amalgam resistant to stress cracking in a chloride-ion fluid environment.

Stainless steel, particularly austenitic chromium-nickel-stainless steels, has found widespread use in many applications such as boilers, power plants and the like. For instance, stainless steel is widely used in such areas as the petrochemical field, desalinization installations and electric utility plants. From its inception, the use of stainless steel has always presented some problems in its industrial applications; but, in particular, there is the pesky unpredictable problem of what is referred to as "stress corrosion cracking", that is, the occurrence of brittle fractures in steel.

While the term stress corrosion cracking is widely used to describe such stainless steel fractures, it is thought that the inclusion of the word "corrosion" in such a term is misleading. While undoubtedly cracking in stainless steel is a corroding process, corrosion of the type that causes cracking is focused on those specific areas of the stainless steel surface at which cracking occurs rather than throughout the stainless steel surface as the term corrosion implies. Therefore, it is thought that a more appropriate term for such cracking is "stress cracking" and this term is used hereinafter to describe the occurrence of such fractures in stainless steel.

Because the risk of industrial failures of austenitic stainless steel by stress cracking in chloride-bearing electrolytes is high, considerable effect has been made into eliminating or substantially reducing such cracking since not only is replacement of the stainless steel expensive, but also the cost of plant operations is increased from shutdown for repairs. Stress cracking in stainless steel results from the simultaneous action of tensile stress and a chloride-oxygen containing environment. The chloride-bearing electrolytes are recognized as being a source of cracking of austenitic stainless steels; and although there is not complete agreement on the mechanism by which the chloride-ion attacks the steel, it is recognized as being the culprit.

2. The Prior Art

The potency of the chloride-ion in producing stress corrosion cracking has been well demonstrated. The authorities are in general agreement that the cracking can occur readily in stainless steel specimens immersed in water containing only a few parts per million of chloride-ions. The temperature of the chloride-ion containing water is not particularly significant in producing such cracking as, in addition to producing cracking at boiling temperatures and above, water temperatures as low as 75° C. even in such dilute solutions have been known to produce cracking in stainless steel. Furthermore, such cracking appears to occur in specimens both stressed and unstressed; and there appears to be little difference between the resistance of stainless steel to cracking between the various types of stainless steel.

One prior art effort has been to attempt to eliminate the chloride-ions from the water or other solutions with which the stainless steel is contacted to thereby reduce stress cracking. In the nuclear reactor field, particularly in the power generating nuclear reactor plant, conduits such as pipes, tubing, pipe fitting, etc. are generally formed from stainless steels; and in such reactors, wherein both a primary and a cooling water system is utilized, it is extremely important to eliminate any cracking in the conduits of the cooling system since repair or replacement is difficult or, at best, extremely costly from the standpoint of down-time if stress cracking occurs. It is, therefore, the common practice to subject the water used in such cooling water systems to extensive purification processes to eliminate all traces of the chloride-ion to avoid such cracking. It can be understood that due to the vast quantities of water used in such systems such as a nuclear reactor cooling water system, such water purification processes are extremely expensive and utilize equipment of extremely high cost. Furthermore, even though the processed water is subjected to such purification processes, some traces of the chloride-ion generally remain so that stress cracking cannot normally be eliminated.

SUMMARY OF THE INVENTION

Accordingly, the general object of this invention is to provide a method for inhibiting stress cracking of stainless steel in contact with a chloride-ion environment.

Another object of this invention is to provide a method of inhibiting stress cracking of stainless steels which requires the use of only trace quantities of metallic mercury.

Still another object of this invention is to provide a process for eliminating stress cracking in stainless steel constructions exposed to water containing chloride-ions, such as in the cooling water system of a pressurized water nuclear reactor.

A still further object of this invention is to provide a mercury/stainless steel amalgam resistant to stress cracking particularly for use in nuclear reactors.

Other objects, features and advantages of the invention will become apparent from the following detailed description.

The objects of this invention are accomplished by coating the surface of stainless steel with mercury. The mercury exerts an electrochemical potential on the exposed stainless steel surface so as to increase the uniformity of the electric potential of the stainless steel surface, thereby eliminating concentrated non-uniform electrochemical attack on the isolated specific anodic areas of the surface and attendant cracking.

DETAILED DESCRIPTION OF THE INVENTION

It has been found that when stainless steel is coated with mercury to form an amalgam only a few atoms thick, the metal having been deposited at least in minute quantities on the stainless steel surface, produces the effect of substantially reducing and, in some cases, eliminating stress cracking when the coated stainless steel surface is subjected to a chloride-ion environment.

Mercury may be deposited on the surface of stainless steel by a number of methods, one such method having been disclosed in applicant's copending application Ser. No. 254,452, filed May 18, 1972, and now now U.S. Pat. No. 3,880,585 in which mercuric nitrate in solution is contacted with the stainless steel surface.

However, according to an embodiment of this invention, stainless steel is coated with the metallic mercury, such as by floating the stainless steel on a pool of mercury or, as in the case of pipes, passing liquid mercury throughout the interior of the pipe. Alternatively, stainless steel surfaces may be coated with mercury which has already been exposed to or is presently exposed to a chloride-ion environment.

As will be shown in the following examples, the mercury/stainless steel amalgam exhibits corrosion inhibition quite effectively with coatings only a few atoms thick. To form this mercury/stainless steel amalgam only using the process described in copending application Ser. No. 254,452, mercuric nitrate monohydrate [$Hg(NO_3)_2.H_2O$] is introduced into a chloride-ion containing electrolyte in an amount within the range of 2–1,000 parts per million of the chloride-ion fluid. When exposing the stainless steel surface to the metallic mercury in the presence of a chloride-ion environment, it has been found helpful to adjust the pH of the chloride-ion environment with a mineral acid, such as nitric acid, and that it has been found that at the lower pH's the mercury appears to more easily and quickly coat the stainless steel surface. It should be appreciated that other water-soluble mercury salts may be used.

Contact of the stainless steel surface with metallic mercury or mercury ions need only last for a few seconds. It is believed that the mercury quickly coats and adheres to the stainless steel surface to form an amalgam in just a matter of seconds. With the selected quantity of mercury added to the electrolyte solution, cracking of the stainless steel immersed in the solution is virtually eliminated. Furthermore, the temperature does not affect the process of this invention.

It is believed that the introduction of metallic mercury or mercury ions into contact with the stainless steel brings about an electrochemical effect on the surface of the stainless steel with which the electrolyte solution is in contact. This electrochemical effect manifests itself in the enlargement of the rather limited number of small, specific anodic areas on the stainless steel surface where cracking characteristically occurs due to the high current density at these anodic areas. The mercury or "inhibitor" appears to enlarge these anodic areas throughout the surface area of the stainless steel, consequently reducing the cathodic areas on the surface with the result that the potential of the stainless steel surface is more uniform. Thus, current density at the grain boundaries or anodic areas is reduced by changing the electrical characteristics of the steel surface from one which is primarily cathodic to one which is uniformly, slightly more anodic, thereby eliminating any high density current attack on the minute highly anodic areas and attendant cracking. As a result of this uniform surface potential, localized attack does not occur. In addition, the steel surface is so passive that there is no detectable increase in the rate of corrosion of the surface. Instead, it appears that the corrosion rate is decreased.

While the electrochemical theory advanced above appears to be well substantiated from the test results, it was noted from the practice of the various processes of this invention that the molecular coating actually occurs on the metal as mercury when either mercuric nitrate is the additive or when the stainless steel is contacted with metallic mercury. It is thus believed, and applicants do not wish to be held to this theory, that it is the mercury coating formed on the stainless steel to produce an amalgam which serves to protect against attack by the chloride-ions in the fluid environment. Thus, it can be seen that the mercury may be deposited on the stainless steel as such or deposited out of solution in minute quantities by chemical oxidative reduction reactions using water-soluble mercury salt.

The practice of this invention may clearly be seen in the following examples.

EXAMPLE 1

This example is set forth to illustrate how unprotected stainless steel reacts to a chloride-ion environment compared to a mercury/stainless amalgam.

The stainless steel specimen was Type 304 stainless steel, 2 × ½ × 1/64 inch, hot-rolled, annealed and pickled. The specimen was held in the solution in U-shaped configuration by glass retainers. The solution in which the specimen without an inhibitor were immersed was an aqueous solution in which 38,000 ppm. HCl had been added. The specimen were allowed to remain in the solution at room temperature until cracking occurred. For comparison mercury/stainless steel amalgams were formed by adding 90 ppm. mercuric nitrate to the aggressive aqueous chloride-ion solution. The specimen were A-4 through A-7, and the results are shown in Table I.

TABLE I

| Specimen | Corrosion Inhibitor | Cracking | Cracking Time to Hrs. |
|---|---|---|---|
| A-1 | None | Yes | 110.5 |
| A-2 | None | Yes | 113.1 |
| A-3 | None | Yes | 113.5 |
| A-4 | $Hg(NO_3)_2$ 90 ppm. | No | — |
| A-5 | $Hg(NO_3)_2$ 90 ppm. | No | — |
| A-6 | $Hg(NO_3)_2$ 90 ppm. | No | — |
| A-7 | $Hg(NO_3)_2$ 90 ppm. | No | — |

The average cracking time for the three unprotected specimen was 112.4 hours; whereas, after 936 hours, no cracking was observed in the amalgams of A-4 through A-7.

EXAMPLE 2

In order to further illustrate the phenomena of this invention, that is, the protective action of mercury on the stainless steel surface, a series of amalgams were made using mercury metal. In the specimens of Table II below, Type 347 stainless steel specimen similar to those of Example 1 were floated on a puddle of mercury metal that had been poured into a 42% magnesium chloride solution until a mercury coating was visually observed. These results were compared to specimen placed in the 42% magnesium chloride solution without benefit of a mercury coating. The results are shown in Table II.

TABLE II

| Specimen No. | Additive | Cracking Time, hours | Corrosion Rate (mils per year) |
|---|---|---|---|
| B-1 | No | 2 | — |
| B-2 | No | 10 | — |
| B-3 | No | 6 | — |

TABLE II-continued

| Specimen No. | Additive | Cracking Time, hours | Corrosion Rate (mils per year) |
|---|---|---|---|
| B-4 | Yes | None observed after 34–37 hours | 210 |
| B-5 | Yes | | 16 |
| B-6 | Yes | | 24 |
| B-7 | Yes | | 222 |

As the results set forth in the examples of Table II show, the period of time required for each amalgimated specimen to crack was considerably longer than the cracking times of the untreated specimen.

EXAMPLE 3

To illustrate the corrosion resistance of a mercury/-stainless steel amalgam in a nuclear reactor simulated environment, the following results were obtained.

A uranyl sulfate test solution was prepared by mixing 2,000 milliliters of an aqueous solution containing 0.04 moles of $UO_2SO_4$, 0.02 moles of $H_2SO_4$ and 0.005 moles of $CuSO_4$ were provided at the temperature of approximately 100° C. Chloride-ions were introduced in the solution as KCl or NaCl to provide a concentration of approximately 50 ppm. of such ions. A uranyl sulfate solution containing 25 ppm. or greater of chloride-ions is very aggressive and produces stainless steel cracking in a relatively short period of time; whereas, water alone containing chloride-ions requires relatively longer periods of time to produce stainless steel cracking.

The solution was constantly stirred by a water-saturated air stream injected into the solution and a condenser was used to return steam as water back to the solution container. Make up water was added to maintain the original volume of the solution throughout the test.

The stainless steel specimen of experiments 1–8 were Type 347 stainless steel, hot-rolled, annealed and pickled with a 2B finish and with edges polished with 80–120 grit. The specimen were cut from a 1/16 inch sheet and were U-shaped in configuration, the free ends being connected by a stainless steel bolt.

The specimen of Experiments 9–12 were of a type stainless steel identified as PH 15–7Mo and were ⅛ inch thick with a 2D finish polished with 80–120 grit. The specimen remained in the solution for the time periods shown, cracks developing after 332 hours in 9(a); but in 9(b), following introduction of 500 ppm. additive into the solution, no cracks on the specimen occurred after 1,000 hours. In experiment 10(a), no cracking occurred within 500 hours when the specimen was placed in the test solution containing the additive shown. However, when the same specimen was placed in fresh test solution containing no additive, cracking occurred within the next 500 hours as shown in experiment 10(b). The specimen of experiments 11 and 12 were of the same type of stainless steel as in experiments 9 and 10 except that the specimen were polished after 1,750° F. heat treatment, formed into a U-shaped configuration and pickled after 950° F. heat treatment.

The results of these experiments are set forth in Table III below:

TABLE III

| Specimen No. | Additive (ppm.) | Cracking | Time (Hrs.) | Corrosion Rate (mpy.) |
|---|---|---|---|---|
| 1 | None | Yes | 50 | |
| 2 | None | Yes | 384 | 19 |
| 3 | 70 $Hg(NO_3)_2$ | Yes | 193 | 18 |
| 4 | 150 $HgCl_2$ | Yes | 247 | 13 |
| 5 | 500 $HgSO_4$ | No | 360 | 3 |
| 6 | 500 $Hg(Cl_2$ | Yes | 96 | 80 |
| 7 | 500 $Hg(NO_3)_2$ | No | 2,000 | 0.02 |
| 8 | 500 $Hg(NO_3)_2$ | No | 2,000 | 0.01 |
| (9(a) | None | Yes | 332 | |
| 9(b) | 500 $Hg(NO_3)_2$ | NO | 1,000 | |
| 10(a) | 500 $Hg(NO_3)_2$ | No | 500 | |
| 10(b) | None | Yes | 500 | |
| 11 | None | Yes | 69 | |
| 12 | 500 $Hg(NO_3)_2$ | No | 2,000 | 0.29 |

It was visually observed that shortly following introduction of the stainless steel coupons into the test solution that a mercury coating appeared to be on the surface of the stainless steel forming amalgam in those experiments wherein the water-soluble mercuric salts had been added to the test solutions.

In summary, from these observations set forth in the Examples, a mercury coating on stainless steel is effective to inhibit stress cracking of stainless steel due to the tremendously increased time that it takes for stainless steel to crack when coated with the mercury.

While there has been described what at present is believed to be the preferred embodiment of the invention, it will be understood by those skilled in the art that various changes and modifications may be made therein without departing from the invention.

What is claimed is:

1. A method of inhibiting stress cracking of stainless steel in a chloride-ion containing fluid environment which comprises, (a) contacting a stainless steel surface with metallic mercury in an amount effective to coat the stainless steel surface, and (b) contacting said mercury-coated stainless steel with said chloride-ion containing fluid environment, whereby stress cracking of said stainless steel surface is inhibited in the presence of said chloride-ion containing fluid environment.

* * * * *